US009850037B2

(12) United States Patent
Beard

(10) Patent No.: US 9,850,037 B2
(45) Date of Patent: Dec. 26, 2017

(54) CLOSURE DEVICE

(71) Applicant: Lynne-Marie Beard, Westlake Village, CA (US)

(72) Inventor: Lynne-Marie Beard, Westlake Village, CA (US)

( * ) Notice: Subject to any disclaimer, the term of this patent is extended or adjusted under 35 U.S.C. 154(b) by 0 days.

(21) Appl. No.: 14/943,419

(22) Filed: Nov. 17, 2015

(65) Prior Publication Data

US 2016/0137356 A1 May 19, 2016

Related U.S. Application Data

(63) Continuation-in-part of application No. 29/509,019, filed on Nov. 13, 2014, now Pat. No. Des. 758,188.

(60) Provisional application No. 62/080,849, filed on Nov. 17, 2014.

(51) Int. Cl.
*B65D 33/16* (2006.01)

(52) U.S. Cl.
CPC ..... *B65D 33/1691* (2013.01); *Y10T 24/15* (2015.01); *Y10T 24/33* (2015.01)

(58) Field of Classification Search
CPC ..... Y10T 24/15; Y10T 24/33; B65D 33/1691
See application file for complete search history.

(56) References Cited

U.S. PATENT DOCUMENTS 3,069,066 A * 12/1962 Peckham ..... B65D 33/1691 383/209
5,608,949 A * 3/1997 Cooley ..... B65D 33/1691 24/30.5 L
2008/0299330 A1* 12/2008 Brizzolari ..... B65D 33/1691 428/5

* cited by examiner

*Primary Examiner* — Robert J Sandy
(74) *Attorney, Agent, or Firm* — Koppel, Patrick, Heybl & Philpott

(57) ABSTRACT

Described herein are devices pertaining to the closure of containers having at least one opening, such as bags. These devices can have at least one connecting structure configured to fit over at least a part of the container's opening, with the connecting structure being connected to at least two sides of the container. In some embodiments, the closure devices have base structures that the connecting structure can connect to and/or be held in place by. In some embodiments, these base structures are configured such that they substantially conceal the portion of the container to which they are connected. In some embodiments, the base structures have festive shapes, for example, being shaped like a birthday cake or flowers. Coupled with the ability to conceal the underlying container, the closure devices can effectively transform a basic paper bag into an enclosed festive gift bag.

20 Claims, 4 Drawing Sheets

CLOSURE DEVICE

CROSS REFERENCE TO RELATED APPLICATIONS

This application is a continuation-in-part of, and claims the benefit of, U.S. Design application 29/509,019 to Lynne-Marie Beard, entitled BAG CLOSURE DEVICE, filed on Nov. 13, 2014, which is now issued as U.S. Design Pat. No. D758,188. This application also claims the benefit of U.S. Provisional Application Ser. No. 62/080,849 to Lynne-Marie Beard, entitled CLOSURE DEVICE, filed on Nov. 17, 2014. Both of these applications are hereby incorporated herein in their entirety by reference.

BACKGROUND OF THE INVENTION

Field of the Invention

The present invention relates to devices for closing bags and other containers, for example, temporary or permanent bag enclosure devices for the construction of gift bags.

Summary

Described herein are devices pertaining to the closure of containers having at least one opening, such as bags. These devices comprise at least one connecting structure configured to fit over at least a part of the container's opening, with the connecting structure being connected to at least two sides of the container. In some embodiments, the closure device comprises additional base structures that the connecting structure can connect to and/or be held in place by.

The closure device can be temporary (i.e. freely removable and replaceable without damaging the bag) or can be permanent. In some embodiments, the closure device can function as a device that can convert a conventional container, such as a bag, into a gift bag. In some of these embodiments, the closure device at least partially covers and/or seals the opening of the container, thus obscuring the contents inside, for example, a gift. In some embodiments, opening of the container can be accomplished by destroying or removing the closure device, thus allowing one to gain access to the contents of the bag. This allows the closure device to be applied to regular non-gift containers a user may have in his or her possession and convert them into gift containers using closure devices, incorporating features of the present invention. This allows a user to conserve materials by re-using unused containers, as well as obviating the need to purchase expensive gift bags. In the gift bag embodiments, the closure device can comprise an aesthetically pleasing shape and appearance, for example, having one or more base structures resembling a cake for a birthday.

In one embodiment, a closure device for a container having at least one opening comprises a first base structure configured to connect to a first side of the container, a second base structure configured to connect to a second side of the container, and at least one connecting structure configured to connect the first base structure and the second base structure, such that the connecting structure is over at least a portion of the at least one opening.

In another embodiment, a closure device for a container having at least one opening comprises a connecting structure comprising a first portion and a second portion, a first base structure configured to connect the first connecting structure portion to a first side of the container, and a second base structure configured to connect the second connecting structure portion to a second side of the container, wherein the connecting structure is over at least a portion of the at least one opening.

In yet another embodiment, a closure device for a container having at least one opening comprises a first base structure comprising a first connection element, the first base structure configured to connect to a first side of the container, such that the first base structure conceals a substantial portion of the first side of said container, a second base structure comprising a second connection element, the second base structure configured to connect to a second side of the container, such that the second base structure conceals a substantial portion of the second side of said container, and at least one connecting structure configured to connect the first base structure and the second base structure, such that the at least one connecting structure is over at least a portion of the at least one opening.

These and other further features and advantages of the invention would be apparent to those skilled in the art from the following detailed description, taken together with the accompanying drawings, in which:

DETAILED DESCRIPTION

Figure 1:
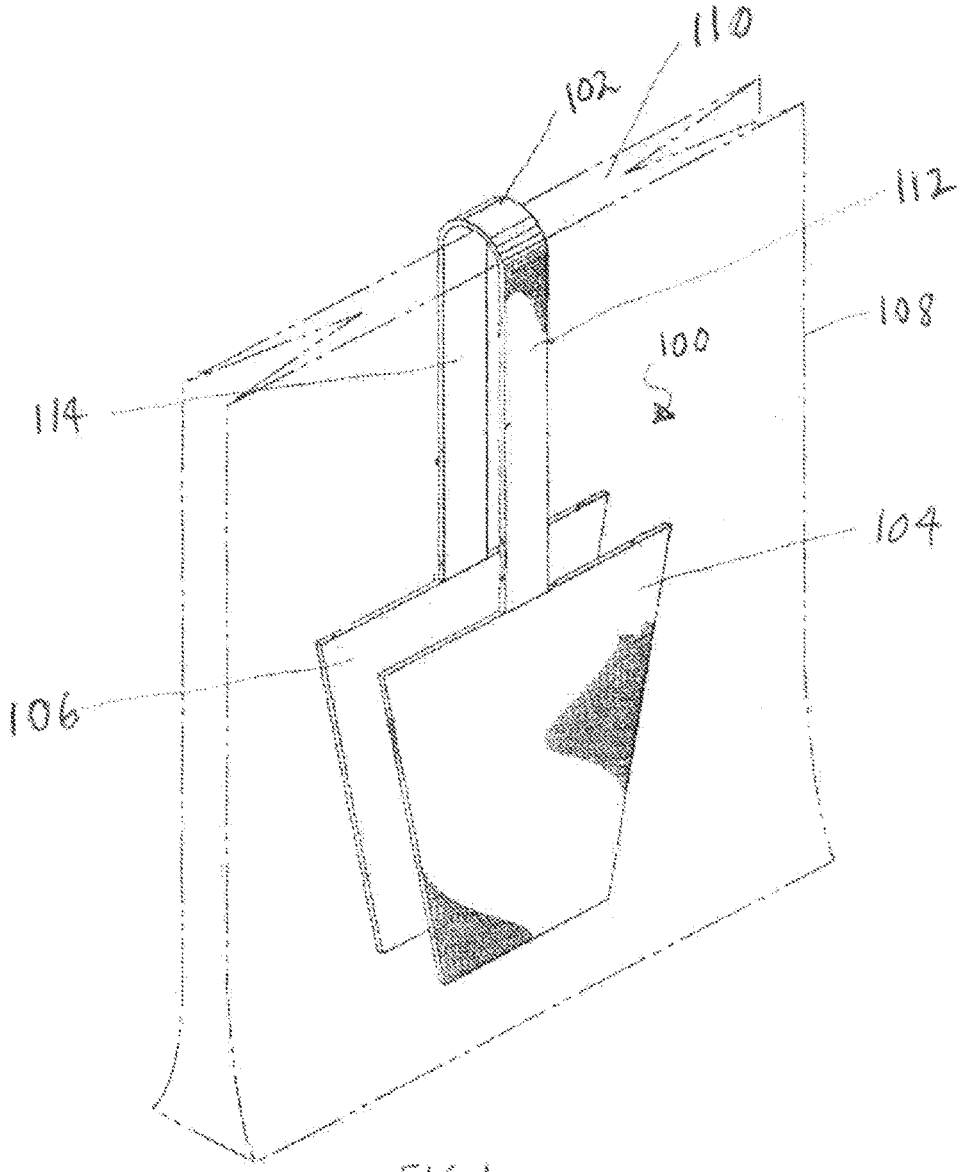
FIG. 1 is a top, front, left side perspective view of an embodiment of a closure device incorporating features of the present invention.

Throughout this description, the preferred embodiment and examples illustrated should be considered as exemplars, rather than as limitations on the present invention. As used herein, the term "invention," "device," "present invention," or "present device" refers to any one of the embodiments of the invention described herein, and any equivalents. Furthermore, reference to various feature(s) of the "invention," "device," "present invention," or "present device" throughout this document does not mean that all claimed embodiments must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "outer", "above", "lower", "below", "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing.

FIG. 1 shows a closure device 100 comprising at least one connecting structure 102 (one shown). Closure device 100 can further comprise one or more base structures, for example, a first base portion 104 and a second base portion 106, as shown in FIG. 1. Closure device 100 is shown configured with a container 108 (in this case a bag). The opening 110 of container 108 can be at least partially covered by connecting structure 102 and can be held shut by closure device 100, as opening 110 is between a first portion 112 of connecting structure 102 and a second portion 114 of connecting structure 102, such that container 108 is held closed. As shown in FIG. 1, the connecting structure 102 can be configured to connect said first base portion 104 and said second base portion 104.

Each of first portion 112 and second portion 114 can be connected to container 108 in one or more of the following ways: 1) connected to different sides of container 108, such that opening 110 is held at least partially shut (for example opposing sides of container 108 as shown); 2) directly connected to different sides of container 108, such that opening 110 is held at least partially shut, for example, in embodiments where closure device 100 does not comprise a base structure; 3) connected to one or more base structures, which are in turn connected to different sides of container 108, such that opening 110 is held at least partially shut; 4) connected to container 108 at different sides, such that first portion 112 and second portion 114 are held in place and/or connected to the sides of the container by one or more base structures, such that opening 110 is held at least partially shut (for example, by being sandwiched between a base structure and a side of the container); and/or 5) any connection configuration that is known in the art.

Closure device 100, including connecting structure 102 and base structures 104, 106 can be made from any suitable material that could provide enough support to allow closure device 100 to hold container 108 closed. Some example materials include, but are not limited to: paper, resin, rubber, vinyl, polyurethane, poly vinyl chloride (PVC), polystyrene foam, polymers/copolymer substances, acrylic substances, plastic, leather, metal, glass, fiberglass, wood, cloth or a combination thereof. The closure device 100 can be formed by any suitable method known in the art, for example, paper folding, molding, injection molding, stamping and extrusion.

If the material chosen for closure device 100 is sturdy enough and the connection to container 108 is freely removable without causing significant damage to container 108 and/or closure device 100, then closure device 100 can be reusable. In some embodiments, closure device 100 comprises one or more materials that can be easily destroyed by intentional manual manipulation, for example, paper which one can rip or tear. In these embodiments, closure device 100 can transform a common conventional container, such as a bag, into a wrapped gift, wherein one can destroy a portion of connecting structure 102 to allow access to a gift contained within the container 108.

While connecting structure 102 and base structures 104, 106 are shown in FIG. 1 as being roughly linear/rectangular and trapezoidal respectively, it is understood that these features can comprise any known shape, including any regular or irregular polygon. Further novel shapes, for example, in the gift bag embodiments are discussed further below in regard to FIG. 4.

Figure 2:
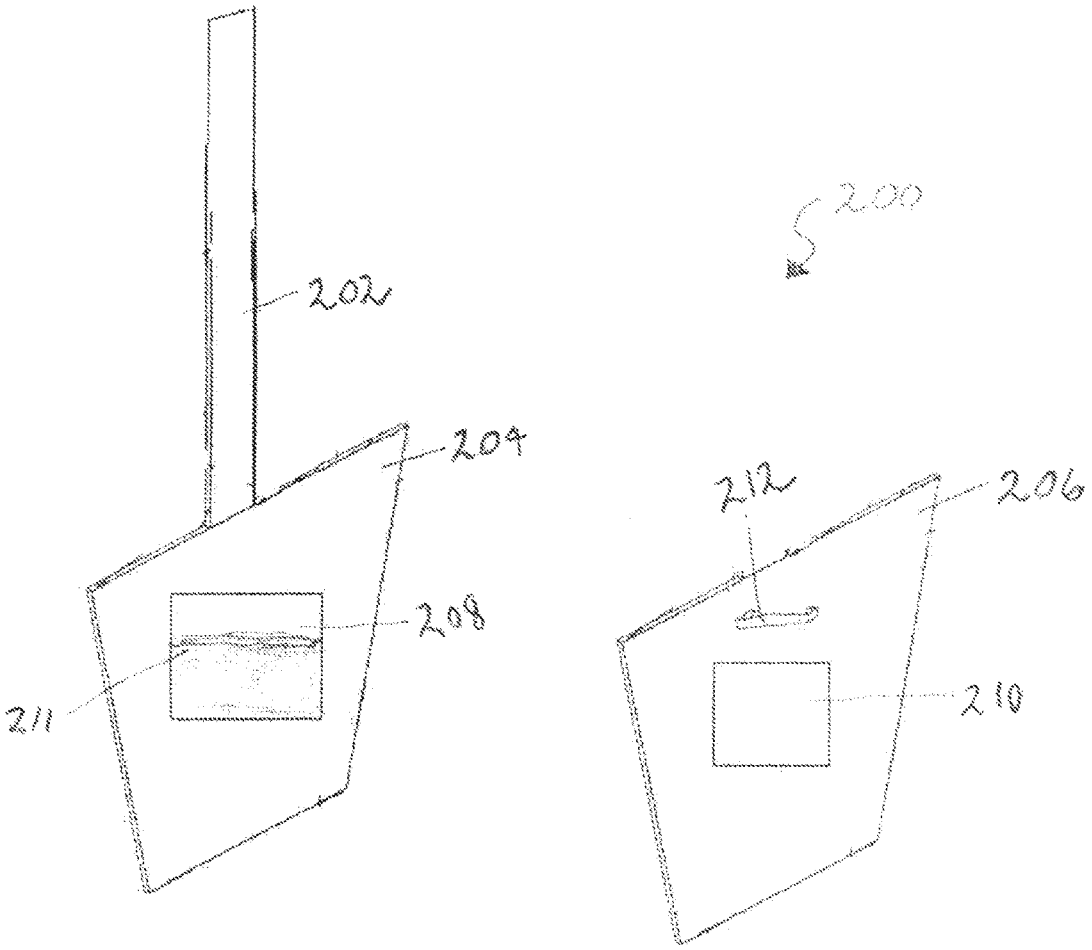
FIG. 2 is an exploded view of an embodiment of a closure device incorporating features of the present invention.

One or more portions of connecting structure 102 and/or one or more portions of base structures 104, 106 can be connected to container 108 in a variety of ways by various connection element including, but not limited to: suction cups, hooks, gripping mechanisms, hook and loop connections (such as Velcro®), male/female connections, adhesives, tapes and any connection configuration known in the art. FIG. 2 shows one such example of one connection configuration. FIG. 2 shows a closure device 200, similar to closure device 100, comprising a connecting structure 202, a first base structure 204 and a second base structure 206. Both first base structure 204 and second base structure 206 are angled in FIG. 2, such that the sides that are to be facing the container to be closed are exposed to view.

First and second base structures 204, 206 are shown comprising first and second adhesive structures 208, 210 respectively, which are configured to connect to a portion of a container that is to be closed. In the embodiment shown, adhesive structures 208, 210 comprise separate adhesive pads connected to base structures 204, 206 which are coated with an adhesive material, such that they can stick to a portion of a container, as discussed above with reference to FIG. 1. In some embodiments, a film 211 covers the adhesive surface of one or more of the adhesive structures 208, 210, which blocks access to the adhesive surface and can be removed by, for example, peeling the film off to expose the adhesive surface when closure device 200 is ready to use.

Closure device 200 can be manufactured and distributed as a single attached unit or in multiple parts as separate components, for example, as three separate parts (e.g. a connecting structure, a first base structure and a second base structure) or two separate parts (e.g. a connecting structure connected to a first base structure and a separate second base structure, as shown in FIG. 2). One advantage of manufacturing closure device 200 as multiple structures is that the length and looseness of connecting structure 202 can be more precisely controlled. For example, the effective length of the connecting structure 202 can be shortened when closure device 200 is used on a container.

In some embodiments, the above-mentioned shortening of the effective length of connecting structure 202 can be accomplished by connecting first base structure 204 to one side of a container, wrapping a desired length of connecting structure 202 over the opening of the container, and then pinning a portion of connecting structure 202 to the opposing side of the container utilizing second base structure 206. Depending on how long or short one wants connecting structure 202 to effectively be, one can connect second base structure 206 to a variable portion of the length of connecting structure 202 on the side of a container opposing the side of the container to which first base structure 204 is connected.

In some embodiments, one of more of base structures 204, 206 can comprise a holding portion 212, which can be used to better contain any excess length of connecting structure 202. Examples of such holding structures include small folds, recesses, handles or spools that can store excess length. In some embodiments, wherein connecting structure 202 is made of a flexible material, such as paper, the excess length can be easily handled by simply folding or bending connecting structure 202 prior to using base structure 206 to connect connecting structure 202 to the opposing side of the container.

Figure 3:
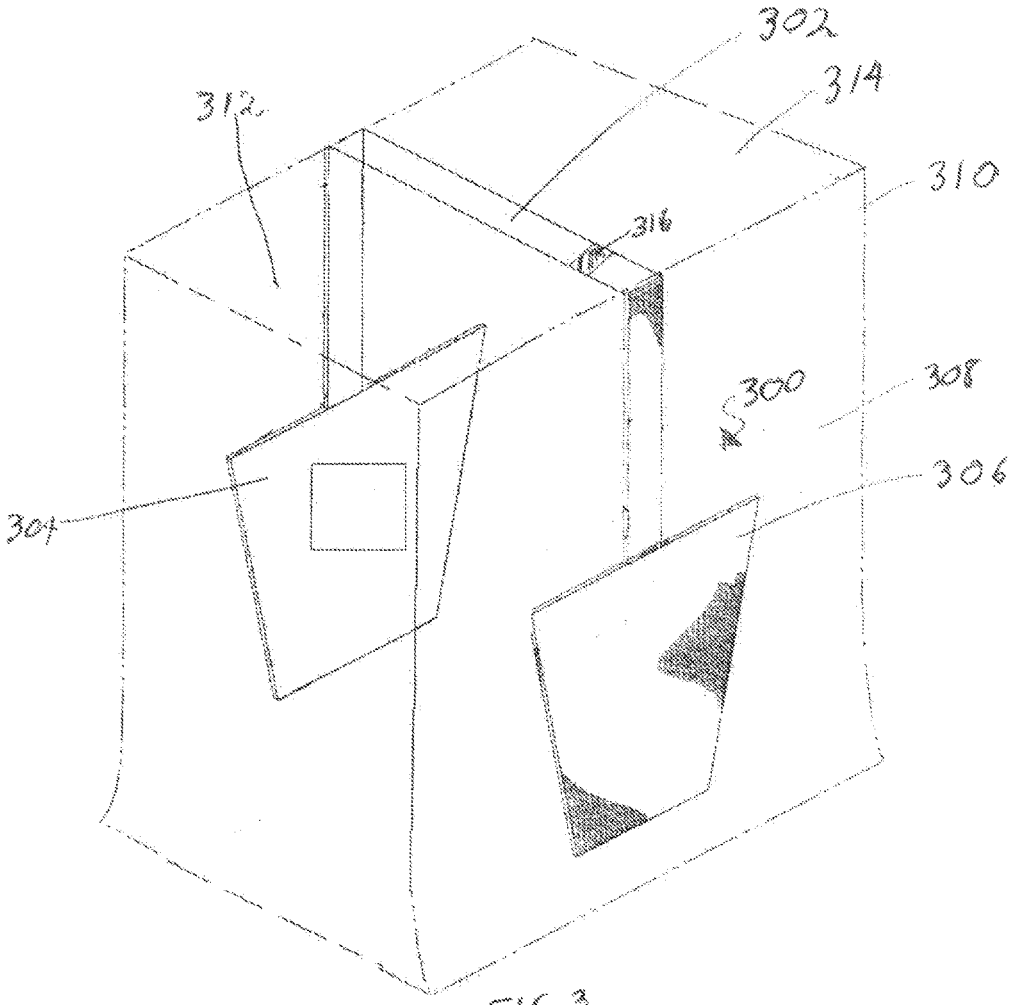
FIG. 3 is a top, front, left side perspective view of a closure device incorporating features of the present invention.

The above mentioned adjustable length feature is shown in more detail in FIG. 3, which shows a closure device 300, similar to closure device 200 discussed in FIG. 2 above. Closure device 300 comprises a connecting structure 302, a first base structure 304 and a second base structure 306. Like in FIG. 2, first base structure 304 and the connecting structure 302 are connected, while second base structure 306 is a separate structure. Second base structure 306 pins connecting structure 302 to the side 308 of container 310, which opposes the side 312 to which first base structure 304 is connected.

The location along the length of connecting structure 302, which second base structure 306 pins to opposing side 308 results in connecting structure 302 having a fairly long-length and slack state of looseness. This allows for a wider opening 314 for container 310. This is useful if container 310 is larger or is containing a larger number of items within it. To adjust the length of connecting structure 302 such that the container 310 is more tightly closed and more closely resembles container 108 in FIG. 1, one would simply connect second base structure 306 to a higher point 316 on connecting structure 302 and pin connecting structure 302 to opposing side 308 at the higher point 316. The additional length of connecting structure 302 that is below higher point 316 could be folded, bent, obscured by base structure 306, or stored in a holding portion as discussed above.

Figure 4:
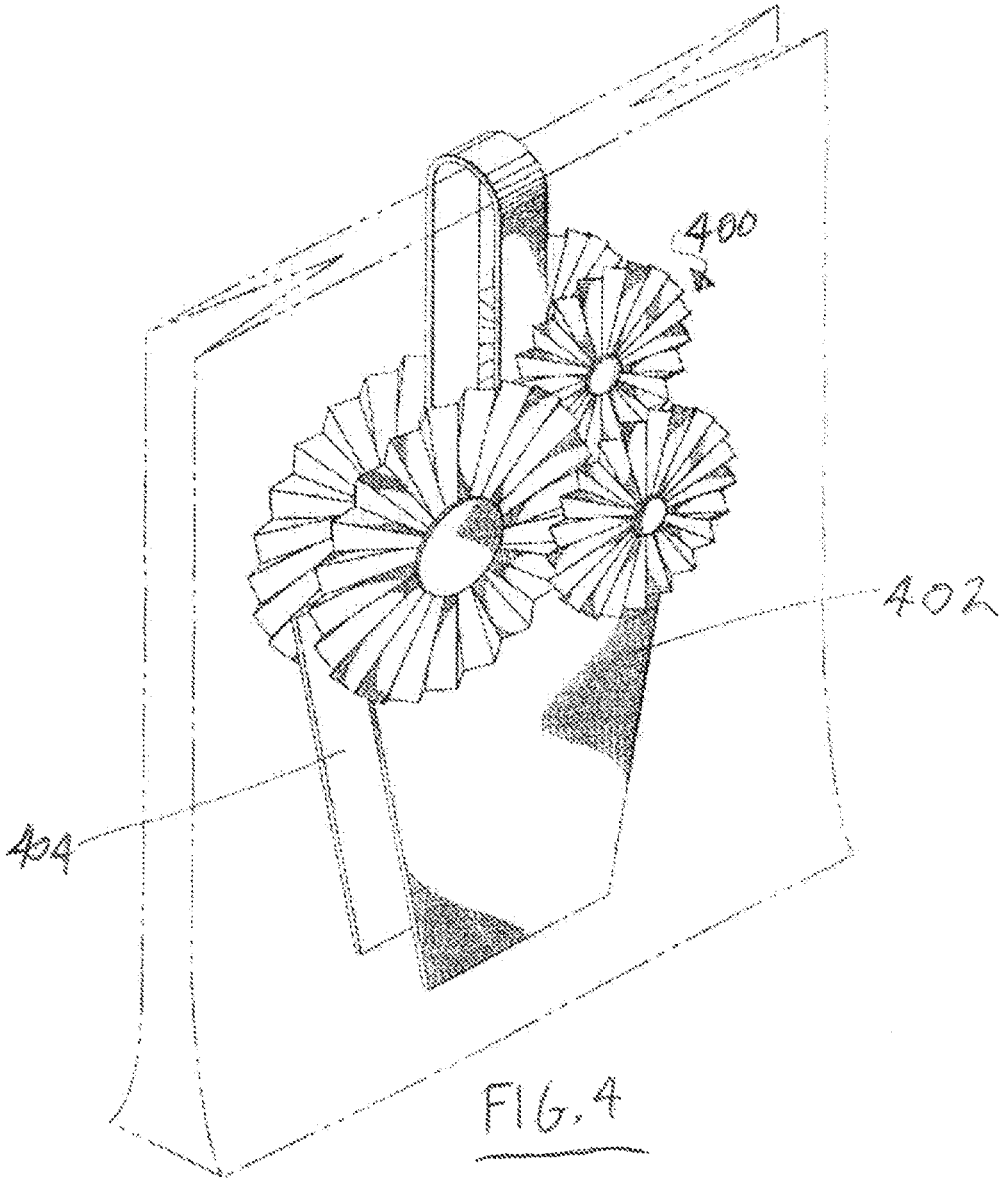
FIG. 4 is a top, front, left side perspective view of a closure device incorporating features of the present invention.

FIG. 4 shows a closure device 400, similar to the closure devices 100, 200, 300 already discussed herein with reference to FIGS. 1-3. Closure device 400 differs in that it comprises a first base structure 402 and a second base structure 404, which comprise festive shapes. This is particularly useful in embodiments wherein closure device 400 is utilized as a gift bag. For example, the base structures 402, 404 could be shaped like birthday cakes for a birthday gift bag, buckets of golf balls for a retirement party or sheriff's badges for a policeman's anniversary. Any number of festive shapes can be implemented for any number of occasions.

In some embodiments, the base structures 402, 404, which can include festive shapes, can hide or mask all or some of a portion of the container, for example, the side to which the base structure 402, 404 is connected. In these embodiments, the overall look or appearance of a container, for example, a common brown bag, can be concealed to appear to be a gift bag, for example, by having the shape, size or dimensions of the base structures 420, 404 match or otherwise correspond to the dimensions of the side of the bag to which the base structures 402, 404 are connected. In this way, closure devices incorporating features of the present invention can simultaneously at least partially close a container and at least partially conceal a container's appearance. In some embodiments, the base structures 402, 404 are configured to conceal a substantial portion of the sides of the container to which they are connected.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention.

I claim:

1. A closure device for a container having at least one opening, comprising:

a first base structure configured to connect to a first side of said container;

a second base structure configured to connect to a second side of said container; and at least one connecting structure configured to connect said first base structure and said second base structure such that said at least one connecting structure is over at least a portion of said at least one opening, wherein said at least one connecting structure can be removably connected to said first base structure or said second base structure such that the effective length of said connecting structure is adjustable.

2. The closure device of claim 1, wherein at least one of said first base structure and said second base structure comprise at least one connection element.

3. The closure device of claim 2, wherein said at least one connection element is an adhesive.

4. The closure device of claim 3, wherein said at least one connection element further comprises a film covering said adhesive when said adhesive is not in use.

5. The closure device of claim 1, wherein said first base structure, said second base structure and said at least one connecting structure are separate components.

6. The closure device of claim 1, wherein said at least one connecting structure is a separate component from one of said first base structure or said second base structure.

7. The closure device of claim 1, wherein said first base structure, said second base structure and said at least one connecting structure are a single component.

8. The closure device of claim 1, wherein said at least one connecting structure comprises a material that can be easily destroyed via manual manipulation.

9. The closure device of claim 8, wherein said at least one connecting structure comprises paper.

10. The closure device of claim 1, wherein at least one of said first base structure and said second base structure are configured to substantially conceal a side of said container to which they connect.

11. A closure device for a container having at least one opening, comprising:

a connecting structure comprising a first portion and a second portion;

a first base structure configured to connect said first connecting structure portion to a first side of said container; and a second base structure configured to connect said second connecting structure portion to a second side of said container, wherein said connecting structure is over at least a portion of said at least one opening, wherein said connecting structure can be removably connected to said first base structure or said second base structure such that the effective length of said connecting structure is adjustable.

12. The closure device of claim 11, wherein at least one of said first base structure and said second base structure comprise at least one connection element.

13. The closure device of claim 12, wherein said at least one connection element is an adhesive.

14. The closure device of claim 13, wherein said at least one connection element further comprises a film covering said adhesive when said adhesive is not in use.

15. The closure device of claim 11, wherein said connecting structure is a separate component from one of said first base structure or said second base structure.

16. The closure device of claim 11, wherein said connecting structure comprises paper.

17. A closure device for a container having at least one opening, comprising:

a first base structure comprising a first connection element, said first base structure configured to connect to a first side of said container, such that said first base structure conceals a substantial portion of said first side of said container;

a second base structure comprising a second connection element, said second base structure configured to connect to a second side of said container such that said second base structure conceals a substantial portion of said second side of said container; and at least one connecting structure configured to connect said first base structure and said second base structure such that said at least one connecting structure is over at least a portion of said at least one opening, wherein said connecting structure can be removably connected to said first base structure or said second base structure such that the effective length of said connecting structure is adjustable.

18. The closure device of claim 17, wherein said first connection element and said second connection element are adhesives.

19. The closure device of claim 18, wherein said first connection element and said connection element further comprise a film covering said adhesives when said adhesives are not in use.

20. The closure device of claim 1, wherein at least one of said first base structure and said second base structure are configured to substantially conceal a side of said container to which they connect.

* * * * *